US009184519B2

(12) United States Patent
Hou et al.

(10) Patent No.: US 9,184,519 B2
(45) Date of Patent: Nov. 10, 2015

(54) CHIP CARD CONNECTOR WITH TERMINALS DISPOSED IN OPENINGS ON TWO SIDES OF A PARTITION PART

(71) Applicant: ADVANCED-CONNECTEK INC., New Taipei (TW)

(72) Inventors: Pin-Yuan Hou, New Taipei (TW); Jin-Fei Li, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 4 days.

(21) Appl. No.: 14/292,444

(22) Filed: May 30, 2014

(65) Prior Publication Data

US 2014/0370756 A1 Dec. 18, 2014

(30) Foreign Application Priority Data

Jun. 17, 2013 (CN) ..... 2013 1 0238882

(51) Int. Cl.
*H01R 24/00* (2011.01)
*H01R 12/71* (2011.01)
*H01R 13/24* (2006.01)

(52) U.S. Cl.
CPC ..... *H01R 12/714* (2013.01); *H01R 13/24* (2013.01); *H01R 24/00* (2013.01)

(58) Field of Classification Search
CPC ..... H01R 12/57; H01R 13/514; H01R 14/00
USPC ..... 439/626–627
See application file for complete search history.

(56) References Cited

U.S. PATENT DOCUMENTS

| | | | | |
|---|---|---|---|---|
| 7,682,197 | B2 * | 3/2010 | Wang | 439/630 |
| 7,798,859 | B1 * | 9/2010 | Yang | 439/630 |
| 2006/0063422 | A1 * | 3/2006 | Lu et al. | 439/489 |
| 2012/0129370 | A1 * | 5/2012 | Zhou et al. | 439/188 |
| 2013/0273782 | A1 * | 10/2013 | Muro | 439/626 |
| 2014/0335735 | A1 * | 11/2014 | Cohen et al. | 439/626 |
| 2015/0104979 | A1 * | 4/2015 | Li et al. | 439/626 |

* cited by examiner

*Primary Examiner* — Chandrika Prasad
(74) *Attorney, Agent, or Firm* — Novak Druce Connolly Bove + Quigg LLP

(57) ABSTRACT

A chip card connector includes a housing and a plurality of terminals. The housing has a partition part and a plurality of openings formed on two sides of the partition part. The terminals are disposed in the openings. Each of the terminals has a first end embedded in or movably attached to the partition part, a second end penetrating a side surface of the housing and exposed from the housing, and a protruding contact part disposed between the first and second end for making contact with a chip card. Therefore, the problem of the prior art is solved that a chip card is likely to hook the contact part pf a conventional chip card connector that has the contact part extending from a cantilever of a terminal when the chip card is plugged into or unplugged from the chip card connector and the terminal are easily deformed or damaged.

8 Claims, 4 Drawing Sheets

CHIP CARD CONNECTOR WITH TERMINALS DISPOSED IN OPENINGS ON TWO SIDES OF A PARTITION PART

The present application is a non-provisional application claiming priority to Chinese Application No. 201310238882.0, filed on Jun. 17, 2013, which is incorporated by reference herein in its entirety.

FIELD OF THE INVENTION

The present invention relates to connectors, and, more particularly, to a chip card connector.

BACKGROUND OF THE INVENTION

A Subscriber Identity Module (SIM) card is included in every cell phone to identify user's ID. The SIM card holds the personal information of the account holder, including phone number, address book, text messages, and other data. In order to embed the SIM card in and connect the SIM card with the cell phone, a connector is required to be disposed in the circuit board inside the cell phone for connecting with the SIM card so as to retrieve and write data in the SIM card.

Regarding the structure of the SIM card connector, Taiwanese Patent No. M360469 discloses a card connector, comprising an insulative body and a plurality of conductive terminals. The insulative body comprises a main body and a plurality of openings formed through the main body and arranged in parallel. The conductive terminals are disposed in the insulative body. Each of the conductive terminals has a fixed part secured in the insulative body and a contact part formed by extending from one end of the fixed part into the opening of the insulative body. The contact part comprises two extending parallel arms extending from the fixed part, a connecting arm connecting the ends of the extending arms, and an elastic arm inclinedly extending from the connecting arm toward a position between the two extending parallel arms. The SIM card is connected with the SIM card connector via the contact part of the SIM card connector, to allow the data to be retrieved and written in the SIM card.

Since different cell phones have different SIM cards of various sizes, an adaptor is required when a smaller SIM card is to be connected to a larger SIM card connector.

Even through the adaptor the smaller SIM card can be connected to a larger SIM connector, there will exist a gap between the SIM card and the adaptor. In addition, the above-mentioned contact part of the SIM card connector is formed as an extension of the elastic arm, as a result, when the smaller sized SIM card is coupled with or separated from the SIM card connector, the SIM card may be stuck by the gap and fail to be connected with the contact part of the SIM card connector, or it is likely that the contact part may be damaged when inappropriate force is applied when connecting the SIM card to the SIM card connector.

SUMMARY OF THE INVENTION

In light of the foregoing drawbacks of the prior art, the objective of the present invention is to provide a chip card connector, by changing the structure of the plurality of conductive terminals of the chip card connector to solve the foregoing problem of deformation of the contact part of the terminals caused by the gap between the adaptor and the SIM card.

The chip card connector, according to the present invention, comprises: a housing having a partition part and a plurality of openings formed on two sides of the partition part; and a plurality of terminals disposed in the openings, each of the terminals having a first end embedded in the partition part, a second end penetrating a side surface of the housing and exposed from the housing, and a protruding contact part formed between the first end and the second end.

In another embodiment according to the present invention, a chip card connector is provided, which comprises: a housing having a partition part and a plurality of openings formed on two sides of the partition part that penetrates the housing, the partition part having a plurality of baffle plates corresponding in position to the openings, each of the baffle plates having a bonding surface at a bottom portion thereof; and a plurality of terminals disposed in the openings, each of the terminals having a first end movably attached to the bonding surface of one of the baffle plates, a second end penetrating a side surface of the housing and exposed from the housing, and a protruding contact part formed between the first end and the second end.

In summary, unlike the prior art wherein the contact part is formed by extending arms, the present invention features in that the contact part is formed between the two ends of the terminal, such that when the SIM card is coupled with the chip card connector, the contact part makes contact with the chip of the chip card. Since the contact part according to the present invention is not formed as extending arms, when the SIM card is inserted into or removed from the chip card, the contact part will not be damaged or deformed.

DETAILED DESCRIPTION OF THE PREFERRED EMBODIMENTS

The present invention is described in the following with specific embodiments, so that one skilled in the pertinent art can easily understand other advantages and effects of the present invention from the disclosure of the present invention.

Figure 1A:
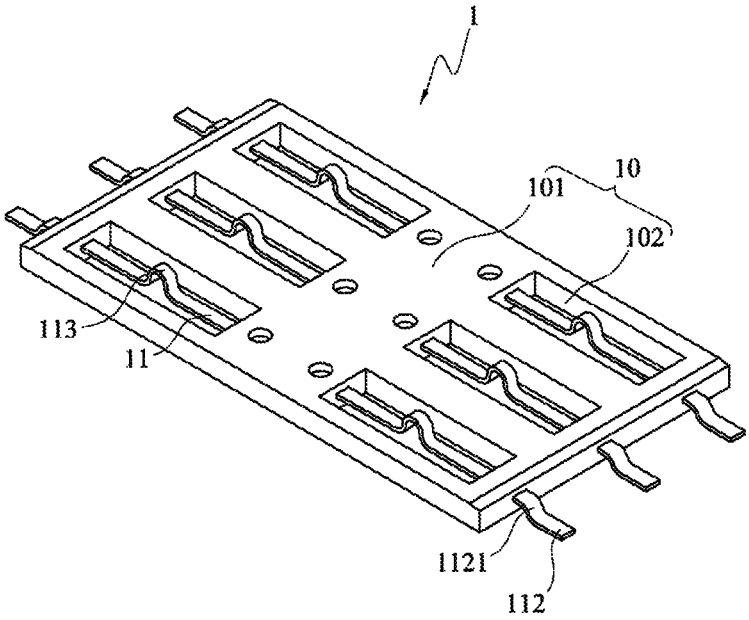
FIG. 1A is a 3D view showing a first embodiment according to the present invention.
Figure 1B:
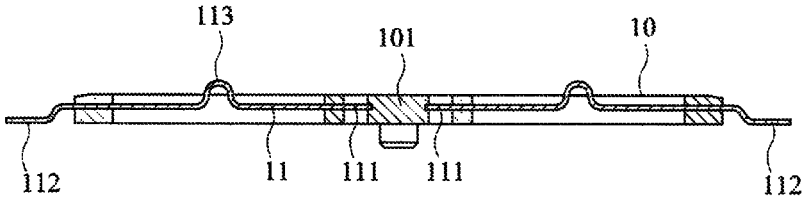
FIG. 1B is a cross-sectional view of FIG. 1A.

FIG. 1A is a 3D view of a chip card connector 1 according to the present invention. FIG. 1B is the cross-sectional view of the chip card connector 1. The SIM card connector 1 comprises a housing 10 and a plurality of terminals 11.

The housing 10 has a partition part 101, and a plurality parallel-arranged openings 102 penetrating the housing 10 and positioned on two sides of the partition part 101.

The terminals 11 are disposed in the openings 102 of the housing 10. Each of the terminals 11 has a first end 111 and a second end 112. The first end 111 of the terminal 11 is embedded in the partition part 101 of the housing 10, and the second end of the terminal 11 penetrates a side surface of the housing 10 and is exposed from the housing 10. A protruding contact part 113 is formed between the first end 111 and the second end 112 of each of the terminals 11, to make contact with a chip of a chip card. A bending part 1121 is formed on the second end 112 of the terminal 11, to be bonded to the circuit board.

Figure 1C:
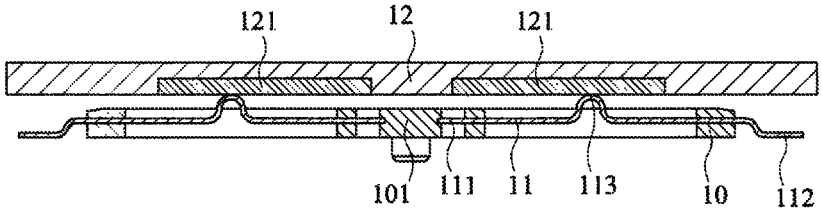
FIG. 1C is a schematic view showing a chip card that is coupled with a chip card connector in accordance with a first embodiment of the present invention.

FIG. 1C is a schematic view of a chip card 12 being coupled with the chip card connector 1 in accordance with the first embodiment of the present invention. The chip card 12 is inserted into and coupled with the chip card connector 1 via a chip 121 of the chip card 12. The chip 121 is connected to the corresponding protruding contact part 113 of each of the terminals 11, so as to allow the data to be retrieved from the chip 121 via the protruding contact part 113, and then sent to the circuit board through the second terminal 112, or the data of the circuit board is written to the chip 121 through the second terminal 112 and then the protruding contact part 113.

Figure 2A:
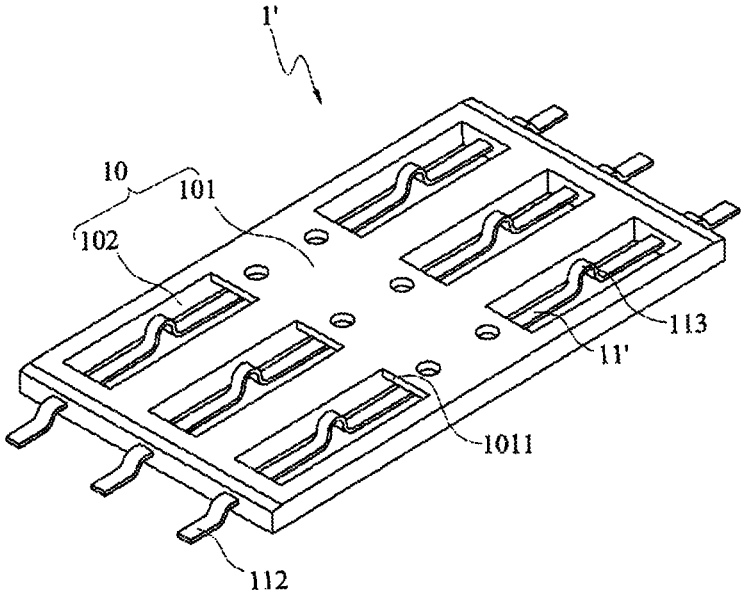
FIG. 2A is a 3D view showing a second embodiment according to the present invention.
Figure 2B:
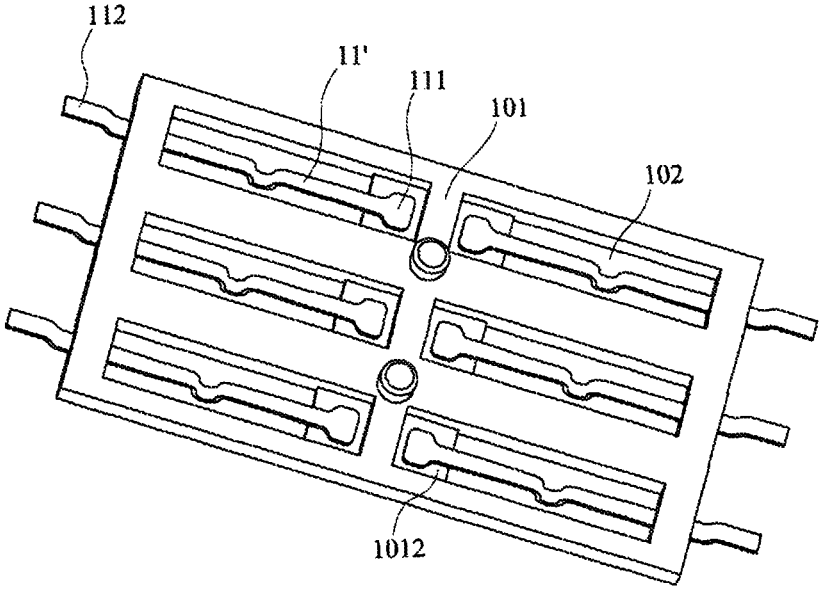
FIG. 2B is a bottom view showing the second embodiment according to the present invention.

FIG. 2A is a 3D view of a chip card connector 1' of a second embodiment according to the present invention. FIG. 2B is a bottom view of the chip card connector 1'. The chip card connectors 1' differs from the chip card connector 1 in that that chip card connector 1' further comprises a plurality of baffle plates 1011 disposed on the partition part 101 of the housing 10 and corresponding in position to the openings 102 to limit the movement of the first ends 111 of the terminals 11'. As shown in FIG. 2B, the bottom of each of the baffle plates 1011 has a bonding surface 1012, and the first end 111 of each of the terminals 11' can be movably attached to the bonding surface 1012.

Figure 2C:
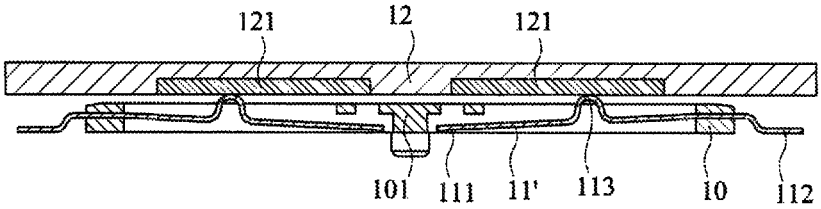
FIG. 2C is a schematic view showing a chip card that is coupled with a chip card connector in accordance with the second embodiment of the present invention.

FIG. 2C is a schematic view of the chip card 12 that is coupled with the chip card connector 1' in accordance with the second embodiment of the present invention. When the chip card 12 is inserted into and coupled with the SIM card connector 1', the contact part of each of terminals 11' makes contact with the corresponding position of the chip 121 of the chip card 12. The protruding contact part 113 of the chip card 12 generates a downwards pressing force. Since the first ends 111 of the terminals 11' are not fixed to the baffle plates 1011 on the two sides of the partition part 101, the pressing force from the chip card 12 allows the first ends 111 of the terminals 11' to be separated from the baffle plates 1011. As shown in FIG. 2C, when the chip card 12 is removed from the chip card connector 1', the terminals 11' return to their original positions, and the first ends of the terminals 11' make contact with the bonding surfaces 1012 of the baffle plates 1011.

Figure 3:
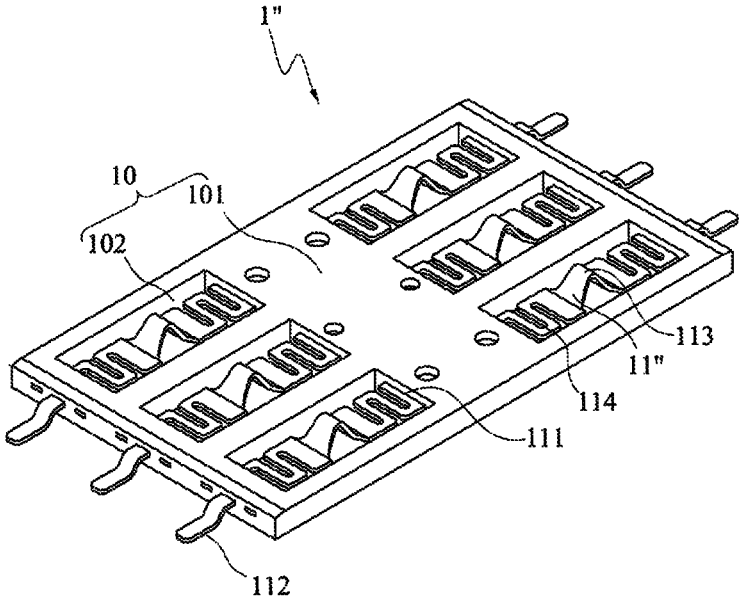
FIG. 3 is a schematic view showing a chip card connector of a third embodiment according to the present invention.

FIG. 3 is a schematic view of a chip card connector 1" of a third embodiment according to the present invention. The chip card connector 1" differs from the card connector 1' in that the chip card connector 1" further comprises buffer structures 114 provided for the terminals 11". Each of the buffer structures 14 is formed between the first end 111 of the terminal 11" and the protruding contact part 113, and between the second end 112 and the protruding contact part 113.

When the chip card 12 is inserted into and coupled with the chip card connector 1", the contact part 113 of each of the terminals 11" makes contact with the chip 121 of the chip card 12, and the chip card 12 generates a downward pressing force against the protruding contact part 113. When a user frequently removes the chip card, it is easy to cause damages to the terminals 11" under a long period of pressure from the chip card.

Therefore, a buffer structure 114 is further provided between the first end 111 of each of terminals 11" and the protruding contact part 113, and between the second terminal 112 and the contact part 113, to reduce the pressing force that the SIM card exerts against the protruding contact parts 113 of the terminals 11", thereby reducing the damages caused to the terminals 11". The buffer structure 114 is a return bending structure, but is not limited thereto. Any person who is experienced in the art can modify the structure of the buffer structure 114.

In summary, in the chip card connectors 1, 1' and 1" according to the present invention, the terminals 1, 11' and 11" have been improved such that the protruding contact part 113 formed between the first end 111 and the second end 112. As a result, when the chip card 12 or adaptor is inserted into or separated from the chip card connectors 1, 1' and 1", it will not be stuck, thereby solving the problem of damages or deformation of the contact part of the prior art due to SIM card being stuck by the contact part of the terminals during coupling with or separating from the SIM card connector.

The present invention has been described using exemplary preferred embodiments. However, it is to be understood that the scope of the present invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A chip card connector comprising:

a housing having a partition part and a plurality of openings formed on two sides of the partition part that penetrates the housing; and a plurality of terminals disposed in the openings, each of the terminals having a first end embedded in the partition part, a second end penetrating a side surface of the housing and exposed from the housing, and a protruding contact part formed between the first end and the second end.

2. The chip card connector of claim 1, wherein the second end has a bending part.

3. The chip card connector of claim 1, wherein each of the terminals further comprises buffer structures formed between the protruding contact part and the first end and between the protruding contact part and the second end.

4. The chip card connector of claim 3, wherein the buffer structure is a returned bending structure.

5. The chip card connector of claim 1, wherein the openings are arranged in parallel.

6. A chip card connector, comprising:

a housing having a partition part and a plurality of openings formed on two sides of the partition part that penetrates the housing, the partition part having a plurality of baffle plates corresponding to the openings, each of the baffle plates having a bonding surface at a bottom portion thereof; and a plurality of terminals disposed in the openings, each of the terminals having a first end movably attached to the bonding surface of one of the baffle plates, a second end penetrating a side surface of the housing and exposed from the housing, and a protruding contact part formed between the first end and the second end.

7. The chip card connector of claim 6, wherein the second end has a bending part.

8. The chip card connector of claim 6, wherein the openings are arranged in parallel.

* * * * *